US008568017B2

(12) United States Patent
Zaiser et al.

(10) Patent No.: US 8,568,017 B2
(45) Date of Patent: Oct. 29, 2013

(54) RADIAL FLOW STEAM INJECTION HEATER

(75) Inventors: Gary Zaiser, Nashotah, WI (US); James Zaiser, Elm Grove, WI (US); Kurt R. Schreib, Mukwonago, WI (US); Lee Richard Van Dixhorn, West Allis, WI (US); Thomas Muenster, Milwaukee, WI (US)

(73) Assignee: Hydro-Thermal Corporation, Waukesha, WI (US)

( * ) Notice: Subject to any disclaimer, the term of this patent is extended or adjusted under 35 U.S.C. 154(b) by 134 days.

(21) Appl. No.: 12/572,394

(22) Filed: Oct. 2, 2009

(65) Prior Publication Data

US 2010/0085833 A1 Apr. 8, 2010

Related U.S. Application Data

(60) Provisional application No. 61/102,378, filed on Oct. 3, 2008.

(51) Int. Cl.
*B01F 15/04* (2006.01)

(52) U.S. Cl.
USPC ..... 366/160.1; 366/132; 366/134; 366/138; 366/167.1; 366/176.2

(58) Field of Classification Search
USPC ..... 366/107, 132, 134, 138, 167.1, 182.1, 366/193, 160.1, 176.2; 261/76
See application file for complete search history.

(56) References Cited

U.S. PATENT DOCUMENTS

| | | | |
|---|---|---|---|
| 4,473,512 | A | 9/1984 | Pick et al. |
| 5,842,497 | A | 12/1998 | Drifka et al. |
| 6,076,809 | A | 6/2000 | Cummins et al. |
| 6,082,712 | A | 7/2000 | Cincotta et al. |
| 6,227,696 | B1 | 5/2001 | Duchnowski et al. |
| 6,341,888 | B1 | 1/2002 | Ekholm et al. |
| 6,955,340 | B2 | 10/2005 | Palm |
| 7,111,975 | B2 | 9/2006 | Fenton et al. |
| 7,188,792 | B2 | 3/2007 | Chase, Jr. |
| 2003/0147301 | A1 | 8/2003 | Ekholm |

FOREIGN PATENT DOCUMENTS

| | | |
|---|---|---|
| CA | 2461046 | 10/2009 |
| EP | 0 839 461 A1 | 5/1998 |
| WO | 99/19057 A1 | 4/1999 |

OTHER PUBLICATIONS

International Search Report dated Jan. 28, 2010.

*Primary Examiner* — Walter D Griffin
*Assistant Examiner* — Timothy Cleveland
(74) *Attorney, Agent, or Firm* — Andrus, Sceales, Starke & Sawall, LLP

(57) ABSTRACT

A radial flow steam injection heater that injects a selected amount of steam into a product flow to heat the product flow. The steam injection heater includes a mixing tube that receives the product flow to be heated. The mixing tube includes a series of steam injection holes that are positioned within a steam chamber defined by the heater body. Pressurized steam within the steam chamber flows into the mixing tube in a direction transverse to the flow axis through the steam injection holes. A regulating member is selectively movable relative to the mixing tube to expose the steam injection holes to the steam chamber to control the amount of steam utilized to heat the product flow.

13 Claims, 10 Drawing Sheets

RADIAL FLOW STEAM INJECTION HEATER

CROSS-REFERENCE TO RELATED APPLICATION

The present application is based on and claims priority to U.S. Provisional Patent Application Ser. No. 61/102,378 filed on Oct. 3, 2008.

BACKGROUND OF THE INVENTION

The present disclosure generally relates to a mixing device for combining and mixing liquids or gases. More specifically, the present disclosure relates to a steam injection heater in which a supply of heated steam flows inward into a slurry or liquid to be heated, where the flow path for the liquid to be heated does not include any flow obstructions.

In direct contact steam injection heaters, steam is directly mixed with a liquid or slurry product to heat the liquid or slurry product. Direct contact steam injection heaters are effective at transferring heat from steam to the liquid or slurry material. Steam injection heaters provide rapid heat transfer with virtually no heat loss to the atmosphere, and also transfer both the latent and available sensible heat of the steam to the material.

In several types of commercially available direct contact steam injection heaters, the flow of material travels in an axial direction and steam flows radially outward from a diffuser into the flow of liquid. In these types of direct contact steam injection heaters, such as shown in U.S. Pat. No. 6,082,712, the flow of slurry travels over an arduous path prior to the injection of steam. While this type of steam injection heater works well with various types of liquids and slurries having a relatively low solid composition, the heater has several drawbacks when heating slurries having a relatively high solid composition. When used with these types of slurries, the solid composition of a slurry often clogs the heater at the point in the heater in which the slurry changes directions.

In addition to the drawback set forth above, presently available direct contact steam injection heaters also create inconsistent heat transfer across the profile of the heater. The currently available direct contact steam injection heaters also have poor condensing characteristics, which can lead to instability and noise within the injection heater. Further, when the currently available direct contact steam injection heaters are utilized with delicate slurries, such as food, any obstructions in the flow path of the material being heated can change the physical properties of the product.

Therefore, a need and desire exists for an improved steam injection heater that can be utilized with slurries having relatively large solid components.

SUMMARY OF THE INVENTION

The present disclosure generally relates to a mixing device for combining at least a pair of liquids or gases. More particularly, the present disclosure relates to a direct contact radial flow injection heater in which a gas or liquid, such as steam, flows generally radially inward into a flow of material or gas to be heated. The radial flow injection heater includes a heater body having a steam chamber that receives a flow of steam. The steam chamber at least partially surrounds a mixing tube that passes through at least the steam chamber of the heater body. The mixing tube in accordance with the present disclosure does not include any flow restricting structures or protrusions that extend into the flow of material passing through the mixing tube. The mixing tube includes a series of steam injection openings that allow steam from within the steam chamber to flow into the material passing through the mixing tube of the steam injection heater.

In one embodiment, a regulating member surrounds the mixing tube. The regulating member is selectively movable relative to the mixing tube to selectively expose a number of the steam injection openings to the pressurized supply of steam within the steam chamber. In one embodiment, the movement of the regulating member along the mixing tube is controlled by an actuator member, which may be either manually controlled or automatically controlled. As the actuator member moves the regulating member along the outer surface of the mixing tube, an increasing number of the steam injection openings are exposed, thus allowing a larger amount of steam to flow into the mixing tube. In an alternate embodiment, the regulating member can be moved in a single movement to expose all of the steam injection openings such that the mixing device can be moved from a fully open condition to a fully closed condition.

In accordance with the present disclosure, the slurry of material to be heated passes along a straight path throughout the steam injection heater. A supply of steam is injected generally radially inward into the flow of material to heat the material. The use of the generally radial flow path of the steam, while not requiring the material being heated to flow around an arduous path, increases the effectiveness of the radial flow steam injection heater relative to other types of heating assemblies.

BRIEF DESCRIPTION OF THE DRAWINGS

The drawings illustrate the best mode presently contemplated of carrying out the invention. In the drawings.

DETAILED DESCRIPTION OF THE INVENTION

Figure 1:
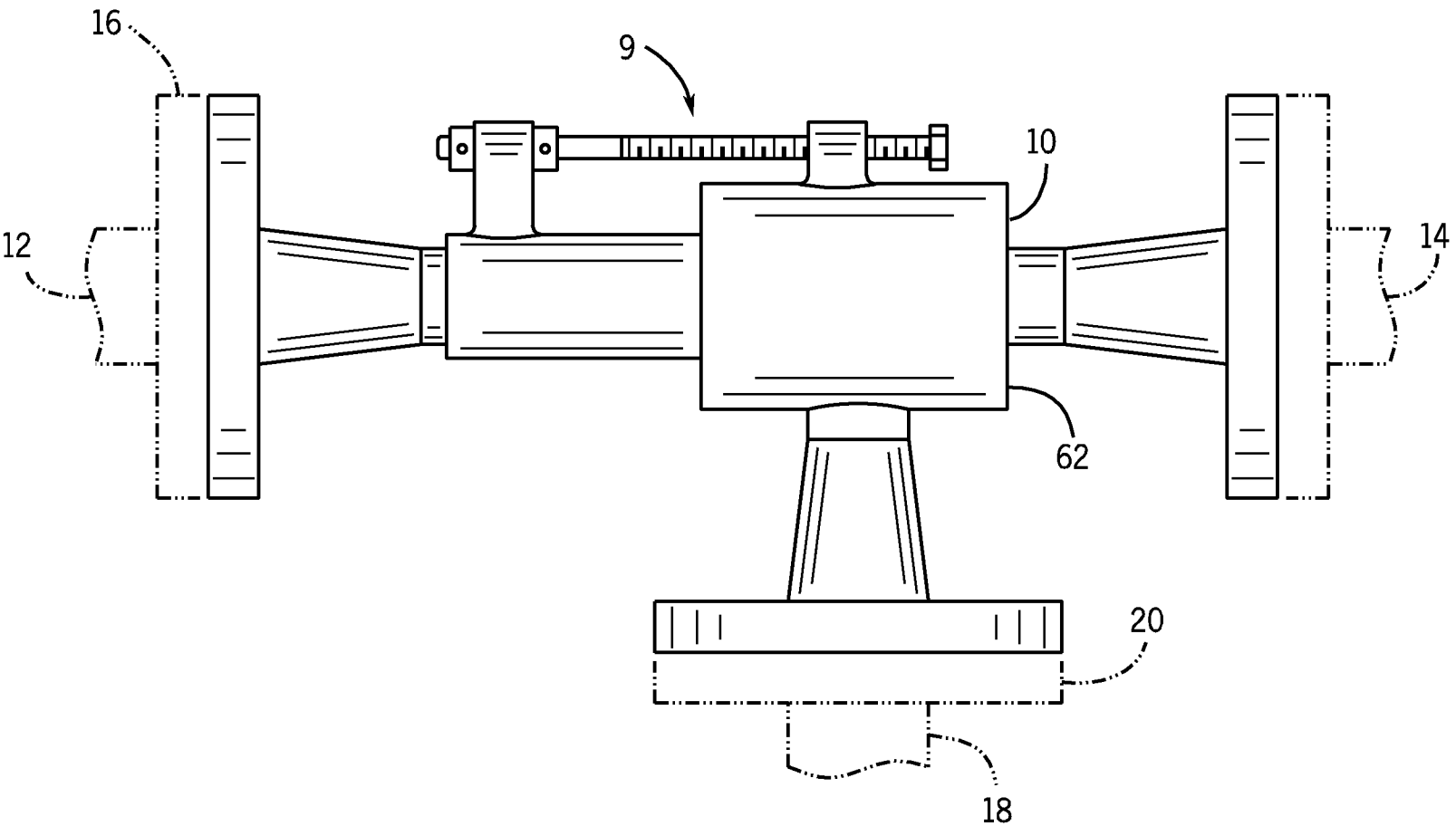
FIG. 1 is a side elevation view showing the radial flow steam injection heater in accordance with the present disclosure.

FIG. 1 illustrates a radial flow mixing device 9 in accordance with the present disclosure. The mixing device 9 is configured to allow a first liquid or gas to be mixed with a second liquid or gas as the first liquid or gas passes through the mixing device 9. Throughout the following description, the mixing device 9 will be shown and described as a steam injection heater 10 that receives a flow of material to be heated and injects steam to heat the material flowing through the steam injection heater 10. However, it should be understood that the mixing device 9 could be utilized to mix various other liquids and/or gases while operating within the scope of the present disclosure.

As illustrated in FIG. 1, the steam injection heater 10 is positioned within a flow of material to be heated. The material, such as a liquid or slurry, flows from an inlet pipe 12 to an outlet pipe 14, each of which include an attachment flange 16. The steam injection heater 10 receives a flow of steam from a steam supply pipe 18 also including an attachment flange 20. As a flow of material enters into the steam injection heater 10, the material is heated by the flow of steam before the material exits through the outlet pipe 14.

Figure 2:
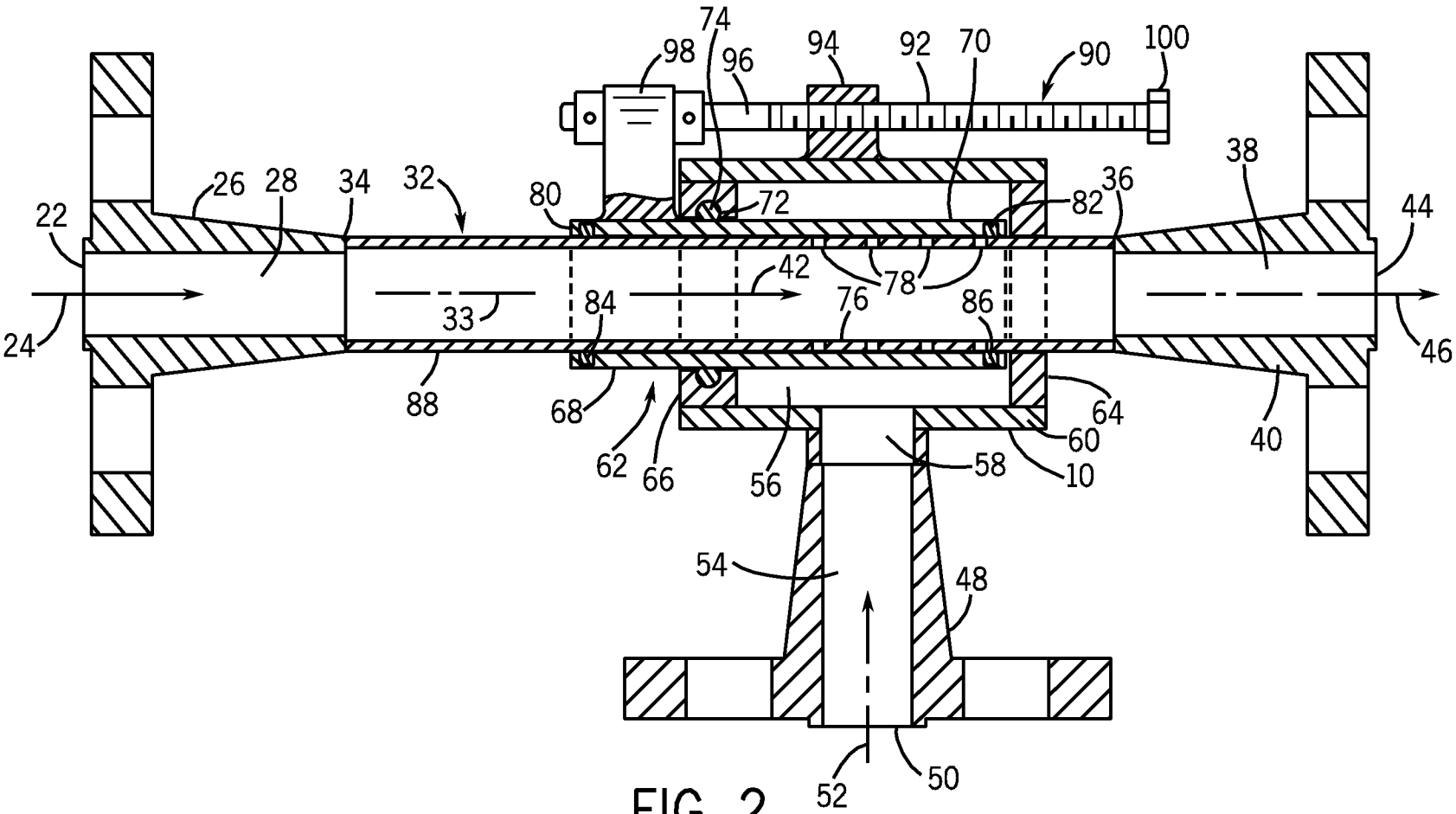
FIG. 2 is a section view of the radial flow steam injection heater with the adjustable regulating member in its fully restricting position.

Referring now to FIG. 2, the steam injection heater 10 includes an inlet opening 22 that receives a liquid or slurry to be heated and flowing in the direction shown by arrow 24. The inlet opening 22 is formed as part of an attachment fitting 26 that includes an inlet flow passageway 28 that is in communication with a central flow passageway 30 formed within a mixing tube 32. The central flow passageway 30 defines a flow axis 33 for the product flow through the mixing tube 32. The mixing tube 32 is preferably formed from a metallic material, such as stainless steel, and extends from a first end 34 to a second end 36. However, it is contemplated that the mixing tube 32 could be formed from other materials, such as thermoplastic. In the embodiment shown in FIG. 2, the mixing tube 32 has a generally constant inner diameter over the entire length of the mixing tube 32.

Although the mixing tube 32 is shown in FIG. 2 as having a constant inner diameter over its entire length, it is contemplated that the mixing tube 32 could have flared opposite ends to utilize the Venturi principle for low steam pressure applications. In such an embodiment, the section of the mixing tube 32 in which steam enters into the product flow would most likely have a constant inner diameter mixing section while sections of the mixing tube both upstream and downstream of the mixing section would have an increasing inner diameter to take advantage of the Venturi principle.

The second end 36 of the mixing tube 32 is aligned with an outlet flow passageway 38 formed within the attachment fitting 40. Thus, after the liquid or slurry material flows through the mixing tube 32, as illustrated by arrow 42, the heated material exits the attachment fitting 40 at the outlet opening 44, as illustrated by arrow 46.

In addition to the attachment fittings 26 and 40, the radial flow steam injection heater 10 includes a steam fitting 48 having a steam inlet 50 that receives a supply of steam flowing in the direction shown by arrow 52. The steam within the flow passageway 54 enters into an open steam chamber 56 through a steam inlet 58 formed in an outer wall 60 of a heater body 62. The heater body 62 includes the generally cylindrical outer wall 60 that defines the generally cylindrical open steam chamber 56. The heater body 62 includes a first end wall 64 that surrounds and engages the outer surface of the mixing tube 32 near its second end 36. The heater body 62 further includes a second end wall 66 that surrounds and engages an outer surface 68 of a movable regulating member 70. As will be discussed in much greater detail below, in the embodiment shown in the Figures, the regulating member 70 has a generally tubular configuration and is movable relative to the stationary mixing tube 32 to control the amount of steam entering into the flow passageway 30 from the steam chamber 56. Although the regulating member 70 and the mixing tube 32 are shown in the illustrated embodiment, it should be understood that both the regulating member 70 and the mixing tube 32 could be formed in other configurations, other than as tubes, while operating within the scope of the present disclosure.

Additionally, although the embodiment shown in the Figures illustrates and describes a stationary mixing tube 32 and a moving regulating member 70, it is contemplated that the mixing tube 32 could move relative to the regulating member 70. As will be understood below, the relative motion between the regulating member 70 and the mixing tube 32 allows for a varying amount of steam to be injected into the product flowing through the mixing tube 32.

Further, although the embodiments shown in the figures include both the regulating member 70 and the mixing tube 32 to control the amount of steam injected into the product flow through the mixing tube 32, it is contemplated that the regulating member 70 could be eliminated. In such an embodiment, the amount of steam injected into the product flow is controlled by the steam pressure within the steam chamber 56 and the number and size of the injection openings 78 formed in the mixing tube 32.

As illustrated in FIG. 2, a sealing member 72 is formed within an annular recess 74 in the end wall 66 to prevent the escape of steam from the pressurized steam chamber 56. Preferably, the sealing member 72 is formed from a resilient material, such as rubber, to create a moving seal between the end wall 66 and the outer surface 68 of the regulating member 70.

As illustrated in FIG. 2, the outer wall 76 of the mixing tube 32 includes a series of injection openings 78 that each provides a generally radial passage for steam through the outer wall of the mixing tube 32. In the embodiment shown, the outer wall 76 of the mixing tube 32 includes steam injection openings 78 formed along a portion of the mixing tube 32 positioned between the end walls 64, 66 of the heater body 62. The number and pattern of the steam injection openings 78 formed in the mixing tube 32 can be varied depending upon the particular design of the radial flow steam injection heater 10. Additionally, although the steam injection openings 78 are shown perpendicular to the flow axis 33, the injection openings 78 could be angled to include either upstream, downstream or tangential velocity components. The upstream, downstream or tangential velocity components may aid in mixing or in controlling the fluid flow.

The regulating member 70 extends from a first end 80 to a second end 82. In the embodiment illustrated, the regulating member 70 includes a first sealing member 84 positioned near the first end 80 and a second sealing member 86 located near the second end 82. Both the first sealing member 84 and the second sealing member 86 contact the outer surface 88 of the mixing tube 32 to form a seal therebetween. In the embodiment shown in FIG. 2, both the first and second sealing members 84, 86 are resilient O-rings formed from a flexible material. Depending upon the materials used to form the regulating member 70 and the mixing tube 32, the first and second sealing members 84, 86 could be eliminated or be formed in different configurations.

In the embodiment shown in FIG. 2, the radial steam injection heater 10 includes an actuator 90 for adjusting the position of the regulating member 70. The actuator 90 includes a threaded shaft 92 that passes through a corresponding threaded lug 94 secured to the outer wall 60 of the heater body 62. An attachment end 96 of the threaded shaft 92 is securely received within an attachment block 98 connected to the regulating member 70 near the first end 80. Thus, when the actuator end 100 of the threaded shaft 92 is rotated, the threaded interaction between the threaded shaft 92 and the attachment block 98 causes the regulating member 70 to move along the length of the mixing tube 32. Although the embodiment shown in FIG. 2 utilizes a rotary actuator 90, it is contemplated that various other types of actuators could be used while operating within the scope of the present disclosure. As an example, the actuator 90 could be a linear, non-rotating actuator while operating within the scope of the present disclosure.

FIG. 2 illustrates the regulating member 70 in its fully restricting position in which the regulating member 70 covers all of the steam injection openings 78 formed in the mixing tube 32. Thus, in the position shown in FIG. 2, the second sealing member 86 prevents the steam within the steam chamber 56 from flowing into the liquid or slurry within the flow passageway 30 of the mixing tube 32. Thus, in the condition shown in FIG. 2, the steam within the steam chamber 56 does not heat the flow of liquid or slurry.

Figure 3:
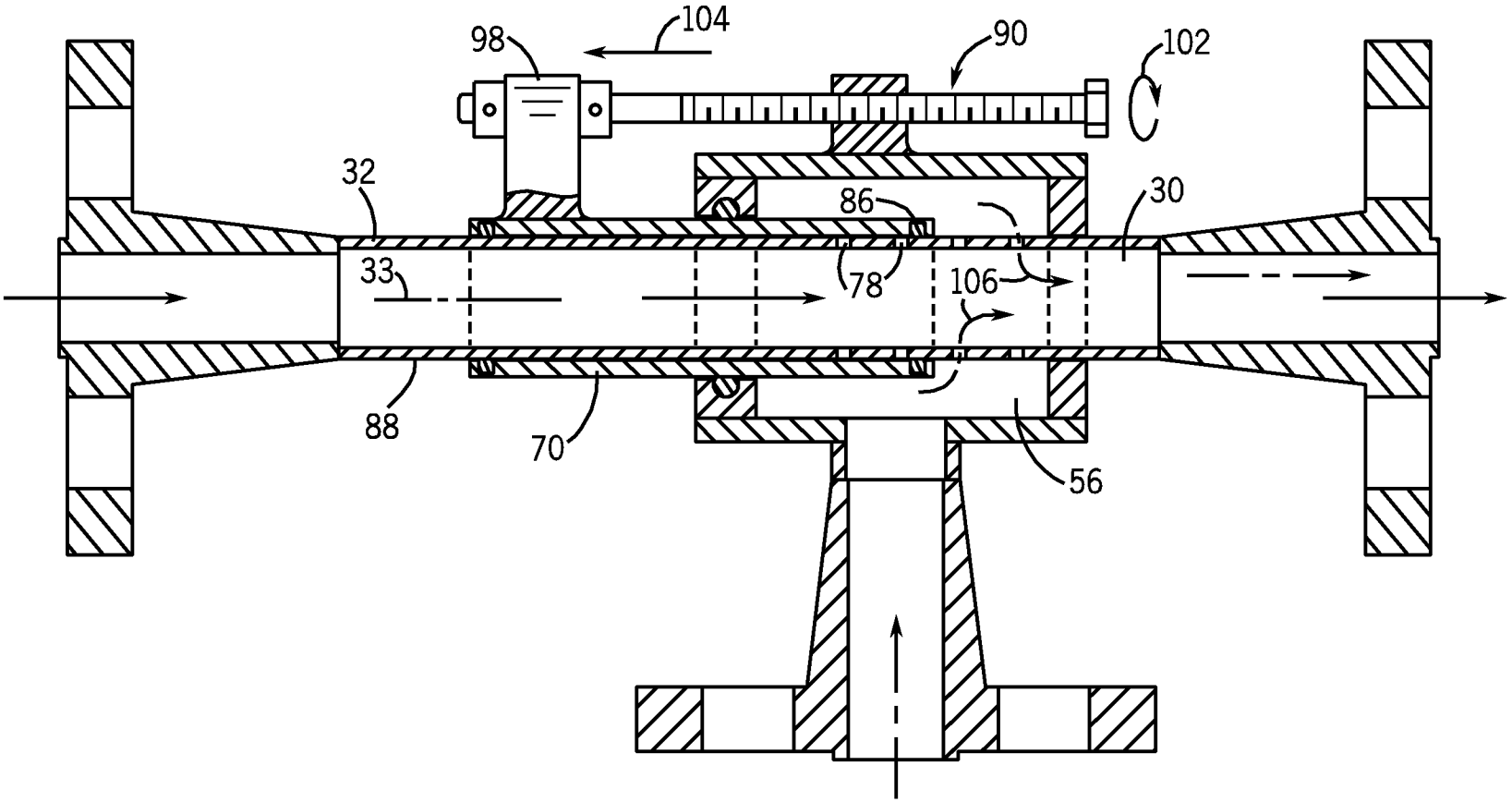
FIG. 3 is a section view similar to FIG. 2 with the adjustable regulating member in a partially open position.

Referring now to FIG. 3, when the actuator 90 is rotated in the direction illustrated by arrow 102, the attachment block 98 moves in the direction shown by arrow 104, which results in the movement of the regulating member 70 in the same direction along the mixing tube 32. As the regulating member 70 moves, an increasing number of the steam injection openings 78 are exposed to the steam contained within the steam chamber 56. Since the steam within the steam chamber 56 is pressurized, the steam flows through the exposed injection openings 78 and into the flow of material within the flow passageway 30 of the mixing tube 32, as illustrated by arrows 106. The flow of steam into the flow passageway 30 is generally perpendicular to the flow axis 33. As the regulating member 70 moves along the mixing tube 32, the second sealing member 86 remains engaged with the outer surface 88 of the mixing tube 32 to prevent steam from flowing through the steam injection openings 78 still covered by the regulating member 70. As can be understood by FIG. 3, the position of the regulating member 70 along the mixing tube 32 controls the amount of steam injected into the flow of material within the flow passageway 30.

Figure 4:
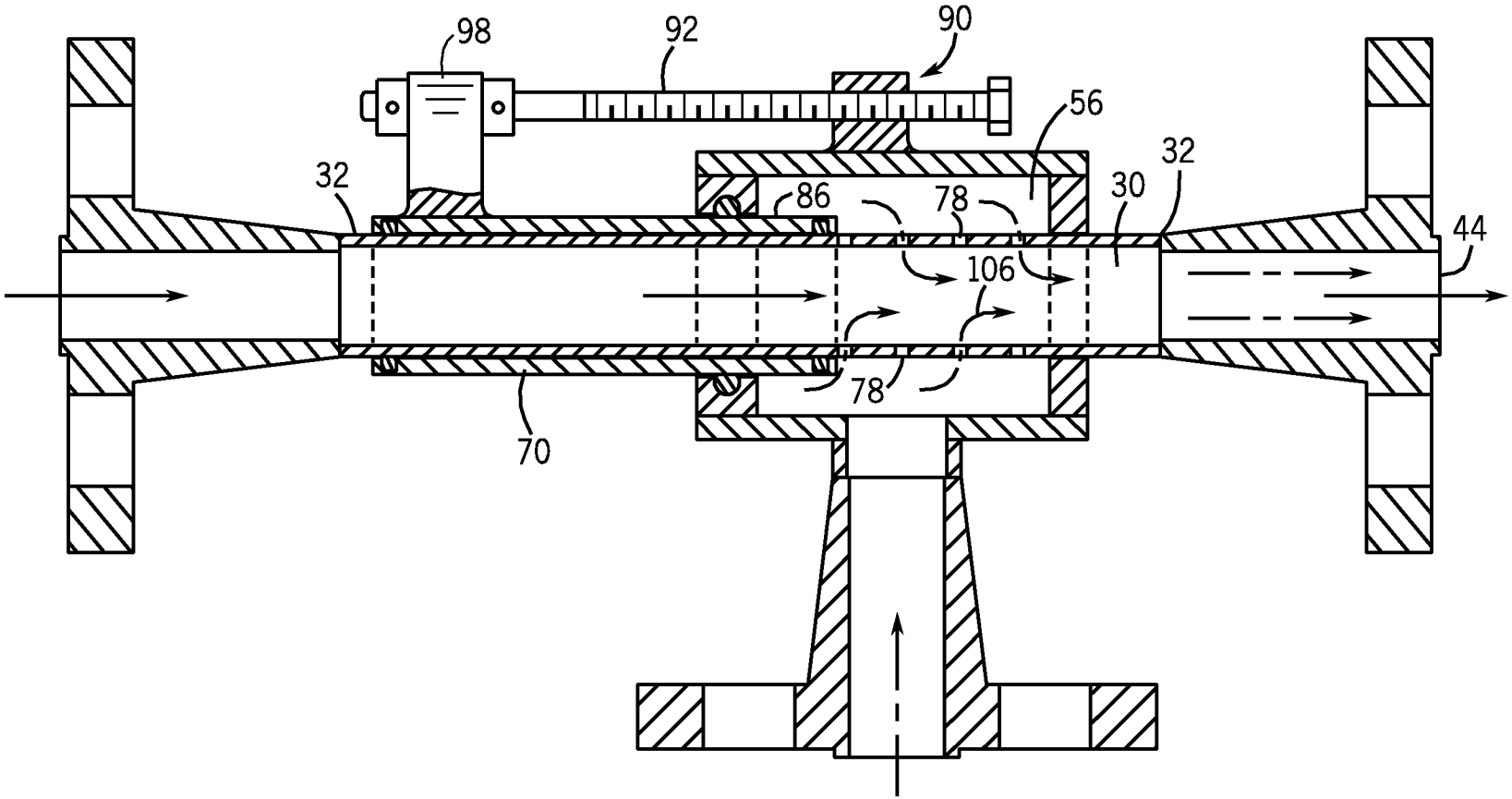
FIG. 4 is a section view similar to FIG. 3 with the regulating member in its fully retracted position.

FIG. 4 illustrates the regulating member 70 in its fully opened position. In this position, all of the steam injection openings 78 formed in the mixing tube 32 are exposed to the steam within the steam chamber 56 such that a maximum amount of steam flows radially inward into the material contained within the flow passageway 30 of the mixing tube 32.

As can be appreciated by the comparison of FIGS. 2, 3 and 4, the position of the regulating member 70 relative to the stationary mixing tube 32 controls the number of steam injection openings 78 that are exposed to the steam within the steam chamber 56. Thus, the actuator 90 can be used to control the amount of steam flowing radially into the flow passageway 30 to control the temperature of the fluid at the outlet opening 44.

Although the regulating member 70 is shown in FIGS. 2-4 as being movable to various different positions between the fully closed position of FIG. 2 and the fully open position of FIG. 4, it is contemplated that the steam injection heater 10 could be designed such that the regulating member 70 is movable only between the fully closed position of FIG. 2 and the fully open position of FIG. 4. In such an embodiment, the regulating member 70 would act as a component that is movable between only an on position and an off position. Further, it is contemplated that the regulating member 70 could be replaced by a similar component that could be moved between an on position in which all of the steam injection openings 78 are exposed and an off position in which all of the steam injection openings 78 are blocked.

As described above, although the embodiment shown in FIGS. 1-4 describes an embodiment in which steam is injected into a flow of material passing through the mixing tube 32, it is contemplated that the mixing device could be utilized to mix various different types of liquids and/or gases.

As can be understood by the foregoing disclosure, the pressure of the liquid/gas within the steam chamber 56 must exceed the pressure of the liquid/gas within the open interior of the mixing tube 32 such that the liquid/gas is injected from the steam chamber 56 into the open interior of the mixing tube 32. As an illustrative example, if the steam in the steam chamber 56 were replaced with a first liquid, the pressure of the first liquid would need to exceed the pressure of the second liquid within the open interior of the mixing tube 32 for the second liquid to flow into the mixing tube 32.

Although the embodiment shown in FIG. 4 includes a manual actuator 90, the manual actuator 90 could be replaced by an automatic system, such as driven by an electric motor. Further, although a threaded shaft 92 is illustrated, various other types of actuator members could be utilized while operating within the scope of the present disclosure. As can be understood in FIGS. 2-4, the actuator 90 is responsible for the movement of the regulating member 70 relative to the mixing tube 32. As described, the regulating member 70 could be stationary and the mixing tube 32 move relative thereto. Any type of actuator that can effect this relative movement between the regulating member 70 and the mixing tube 32 would be acceptable.

Figure 5:
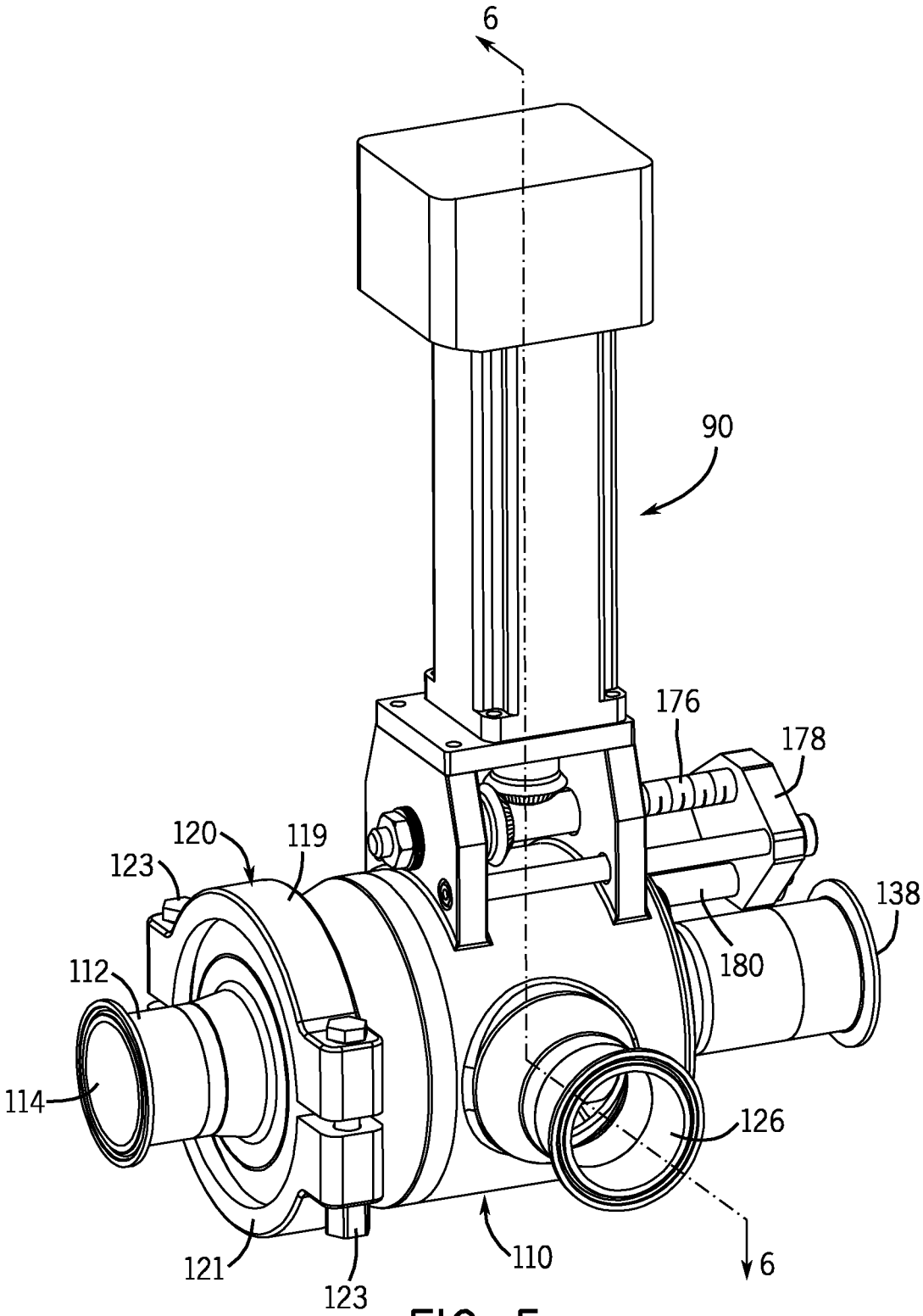
FIG. 5 is a perspective view illustrating a second embodiment of the radial steam injection heater including an actuator operable to adjust the amount of steam injected into a flow of material.

FIG. 5 illustrates an alternate embodiment of the steam injection heater 110 of the present disclosure. Similar to the first embodiment of FIGS. 1-4, the heater 110 is a mixing device that allows a first liquid or gas to be mixed with a second liquid or gas, such as but not limited to steam. The alternate embodiment shown in FIG. 5 provides additional advantages relative to the radial flow steam injection heater 10 shown in FIGS. 1-4 yet operates with the same radial steam flow concept described in FIGS. 1-4.

The steam injection heater 110 of FIG. 5 receives the flow of a product to be heated at an inlet opening 114 and directs the flow of product through the steam injection heater 110 where the heated product flow exits at an outlet opening 138. Steam enters the injection heater 110 through a steam inlet 126. Steam flowing into the steam inlet 126 supplies heat to the liquid or slurry in a similar manner to that described in FIGS. 1-4. In the embodiment illustrated in FIG. 5, an actuator 90 is mounted to the steam injection heater 110 and is operable to control the amount of steam injected into the product flow in a manner as will be described in greater detail below.

Figure 6:
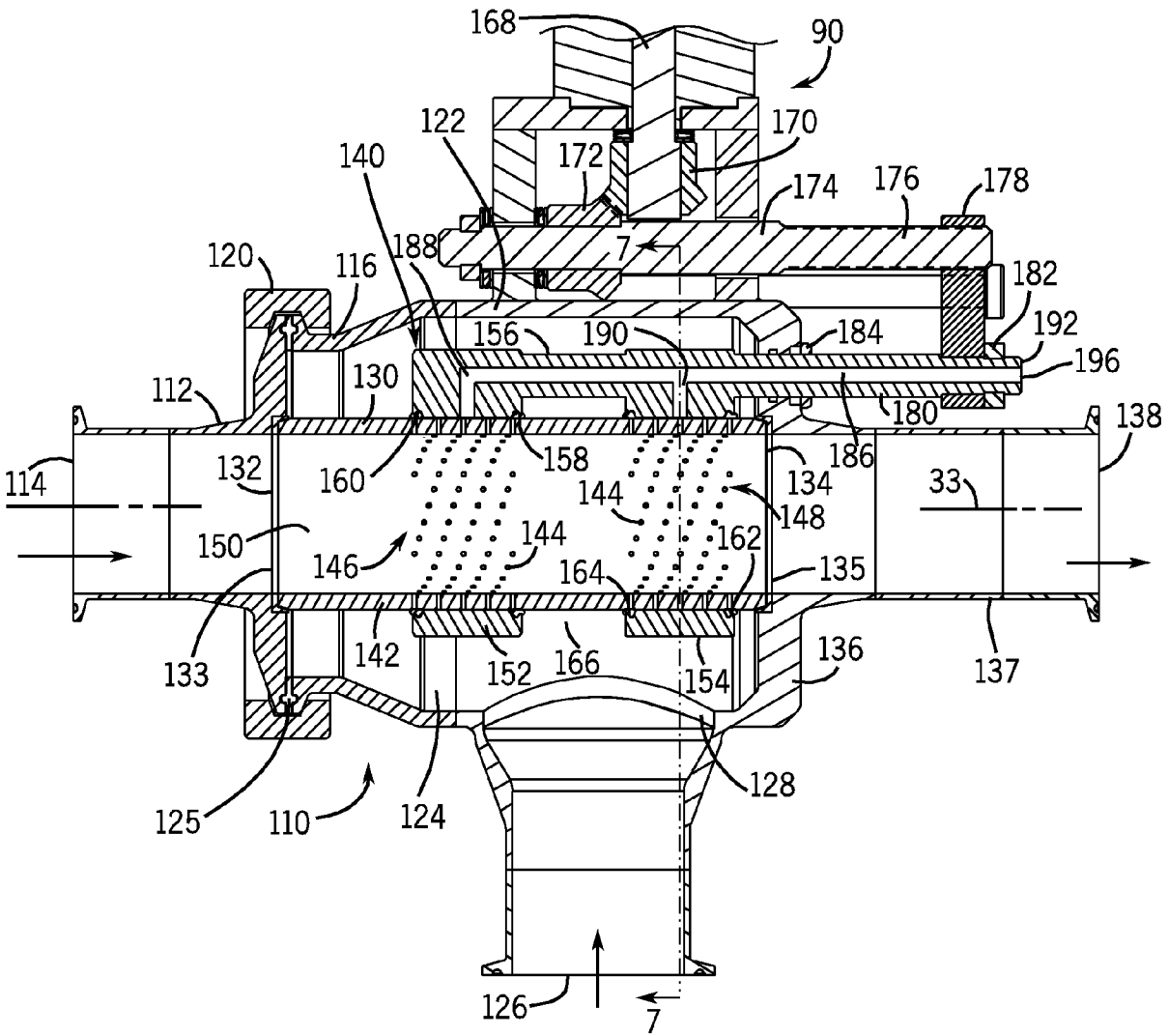
FIG. 6 is a section view taken along line 6-6 of FIG. 5.

As shown in the section view of FIG. 6, the radial flow steam injection heater 110 includes an attachment fitting 112 having an inlet opening 114 for receiving the supply of liquid or slurry to be heated. The attachment fitting 112 is secured to a first end 116 of the heater body 118 by a clamping member 120. The clamping member 120 is utilized in the embodiment shown in FIG. 6 to provide quick and easy attachment of the attachment fitting 112 to the heater body 118.

Figure 7:
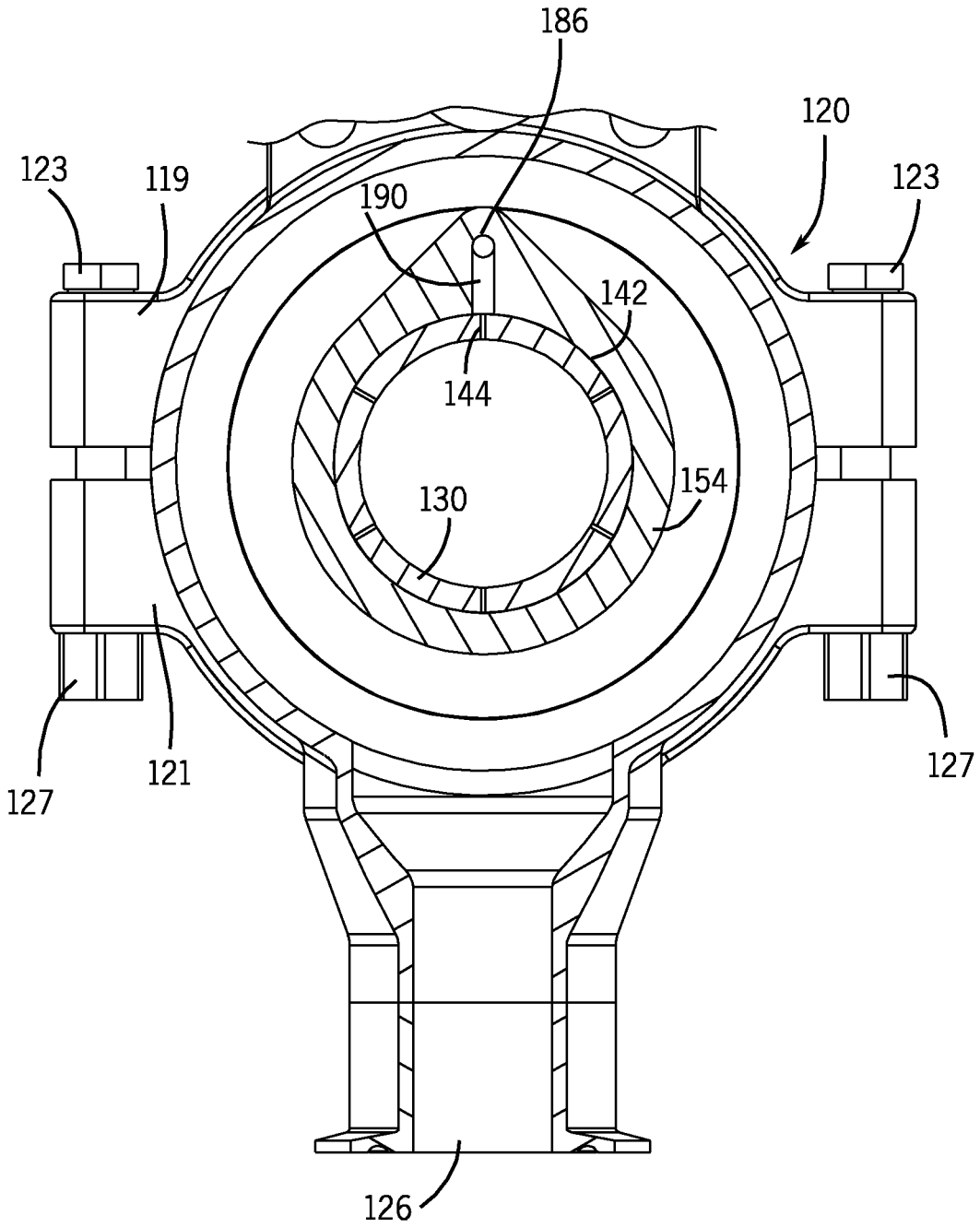
FIG. 7 is a section view taken along line 7-7 of FIG. 6.

As illustrated in FIGS. 5 and 7, the clamping member 120 includes a first section 119 and a second section 121 that are secured to each other by a pair of connectors 123. The connectors 123 are shown as bolts each having a threaded shaft that receives a threaded nut 127 such that the connectors 123 join the first and second sections 119, 121 to securely attach the attachment fitting 112 to the heater body 118.

As illustrated in FIG. 6, a seal 125 is positioned between the first end 116 of the heater body 118 and the attachment fitting 112. As in the embodiments shown in FIGS. 1-4, the outer wall 122 of the heater body 118 defines a steam chamber 124 that receives a supply of steam, or other liquid or gas, through a steam inlet 126. The flow of steam enters the steam chamber 124 through a steam inlet opening 128 formed in the outer wall 122.

In the embodiment shown in FIG. 6, the radial steam injection heater 110 includes a mixing tube 130 that extends between a first end 132 and a second end 134. The first end 132 is received within an annular groove 133 formed in the attachment fitting 112, while the second end 134 is received within a corresponding annular groove 135 formed in the end wall 136. The end wall 136 is joined to an outlet section 137 that defines the outlet opening 138 for discharge of the heated fluid from the radial steam injection heater 110.

The radial steam injection heater 110 includes a modified regulating member 140. The modified regulating member 140 moves along an outer surface 142 of the mixing tube 130 to selectively expose the steam injection openings 144 formed in either a first injection zone 146 or a second injection zone 148. The pair of injection zones 146 and 148 provide for increased control over the amount of steam injected into the flow of liquid passing through a flow passageway 150 formed in the mixing tube 130 as the regulating member 140 moves. Although two injection zones are shown, additional injection zones could be used while operating within the scope of the present disclosure. Alternatively, only a single injection zone could be formed in the mixing tube 130.

As with the first embodiment of FIGS. 1-4, although the steam injection openings 144 are shown perpendicular to the flow axis 33, the injection openings 144 could be angled to include either upstream, downstream or tangential velocity components. The upstream, downstream or tangential velocity components may aid in mixing or in controlling the fluid flow.

Referring back to FIG. 6, the regulating member 140 includes a first regulating section 152 and a second regulating section 154. The first regulating section 152 and the second regulating section 154 are annular members that surround a portion of the mixing tube 130. In the embodiment illustrated in FIG. 6, the first regulating section 152 and the second regulating section 154 are joined to each other by a connecting section 156. The connecting section 156 causes the first regulating section 152 and the second regulating section 154 to move with each other and provides constant spacing between the sections 152, 154.

The first regulating section 152 includes a first annular sealing member 158 and a second annular sealing member 160 that combine to control the exposure of the steam injection openings 144 within the first injection zone 146 as the regulating member 140 moves along the mixing tube 130. Likewise, the second regulating section 154 includes a third annular sealing member 162 and a fourth annular sealing member 164 that control the exposure of the steam injection openings 144 contained within the second injection zone 148 during movement of the regulating member 140. In the embodiment shown in FIG. 6, the annular sealing members 158, 160, 162 and 164 are each resilient members that engage the outer surface 142 of the mixing tube 130. However, in an alternate contemplated embodiment, each of the sealing members 158, 160, 162 and 164 could be eliminated and still maintain the ability to regulate accurately. In such an embodiment, close tolerances between both the first regulating section 152 and the second regulating section 154 with the outer surface 142 will control the amount of steam passing into the flow passageway 150 within the mixing tube 130.

As illustrated in FIG. 6, the first regulating section 152 and the second regulating section 154 are separated by a steam access area 166. The steam access area 166 allows steam to come into contact with the outer surface 142 of the mixing tube 130 between the first and second regulating sections 152, 154.

Similar to the steam injection heater 10 shown in FIGS. 1-4, the radial steam injection heater 110 includes an actuator 90 for moving the regulating member 140 relative to the stationary mixing tube 130. In the embodiment shown in FIG. 6, the actuator includes a driven shaft 168 having a gear 170. Gear 170 cooperates with a corresponding gear 172 fixed to the shaft 174. Rotation of shaft 168 thus results in rotation of the shaft 174. As the shaft 174 rotates, a threaded portion 176 of the shaft 174 rotates within an internally threaded bore formed in an attachment block 178. The attachment block 178 is fixed to a shaft section 180 of the regulating member 140. The shaft section 180 is connected to the second regulating section 154 of the regulating member 140. In the embodiment illustrated, an attachment nut 182 entraps the attachment block 178 between the attachment nut 182 and a shoulder formed on the shaft section 180. The shaft section 180 passes through the end wall 136 of the heater body 118 and is surrounded by a sealing member 184.

The regulating member 140 includes a flushing port 186 that extends through the shaft section 180 and the connecting section 156. The flushing port 186 includes a first branch 188 and a second branch 190. The first branch 188 extends through the first regulating section 152 and is open to the outer surface 142 of the mixing tube 130 between the first sealing member 158 and the second sealing member 160. As shown in FIGS. 6 and 7, the second branch 190 extends through the second regulating section 154 and is in fluid communication with the outer surface 142 of the mixing tube 130 between the third sealing member 162 and the fourth sealing member 164. The flushing port 186 can be connected to a supply of pressurized fluid or air at its attachment end 192.

In FIG. 6, the regulating member 140 is shown in its fully closed position. In this position, the pressurized supply of steam or other liquid within the steam chamber 124 is prevented from flowing into the flow passageway 150 within the mixing tube 130 by the sealing members 158, 160, 162 and 164. As illustrated in FIG. 6, the first and second sealing members 158, 160 surround the steam injection openings 144 contained within the first injection zone 146 while the third and fourth sealing members 162, 164 surround the steam injection openings 144 contained within the second injection zone 148.

Figure 8:
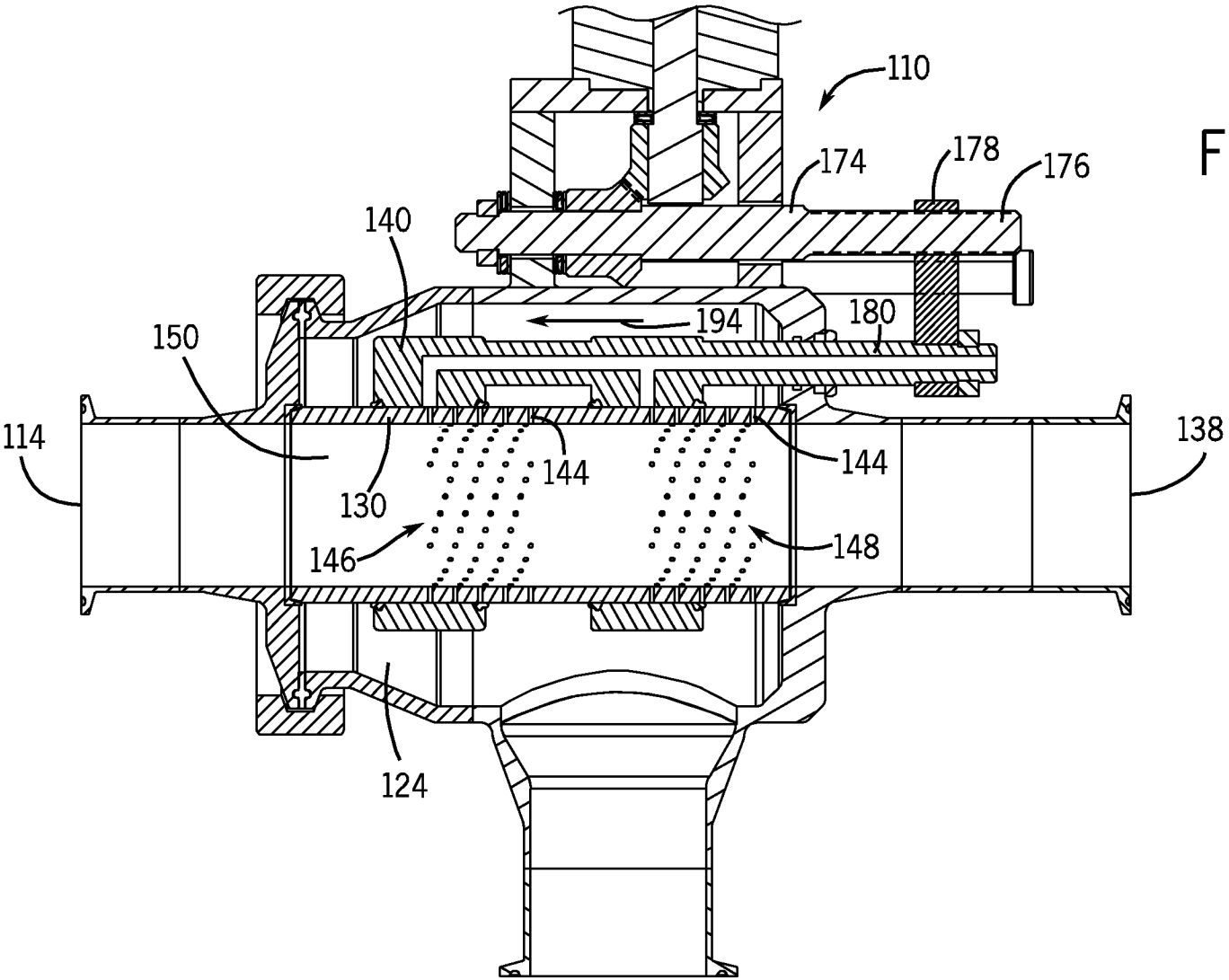
FIG. 8 is a section view similar to FIG. 6 with the adjustable regulating member in a partially open position.

When it is desired to inject steam into the product flow or slurry to be heated, the shaft 174 is rotated, which causes the attachment block 178 to move along the threaded portion 176 in the direction shown by arrow 194 in FIG. 8. Since the attachment block 178 is fixed to the shaft section 180, rotation of the shaft 174 causes the entire regulating member 140 moves in the direction shown by arrow 194.

As the regulating member 140 moves, the first and third sealing members 158, 162 move past some of the steam injection openings 144 in both the first injection zone 146 and the second injection zone 148 such that these steam injection openings 144 are exposed to the pressurized steam within the steam chamber 124. As the steam injection openings 144 are exposed, pressurized steam flows radially inward into the flow passageway 150 along the entire circumference of the mixing tube 130 and mixes with product flowing through the steam injection heater 110.

As can be understood in the comparison between FIGS. 6 and 8, the position of the regulating member 140 within the heater body 118 controls the number of steam injection openings 144 exposed to the pressurized steam or liquid within the steam chamber 124. Specifically, the first and second sealing members 158, 160 engage the outer surface 142 of the mixing tube 130 to control the number of steam injection openings 144 exposed to the pressurized steam in the first injection zone 146. In the same way, the third and fourth sealing members 162, 164 control the exposure of the steam injection opening in the second injection zone 148. Thus, when it is desired to inject additional steam or liquid into the product flow entering the inlet opening 114 and exiting the outlet opening 138, the position of the regulating member 140 can be adjusted relative to the mixing tube 130.

Figure 9:
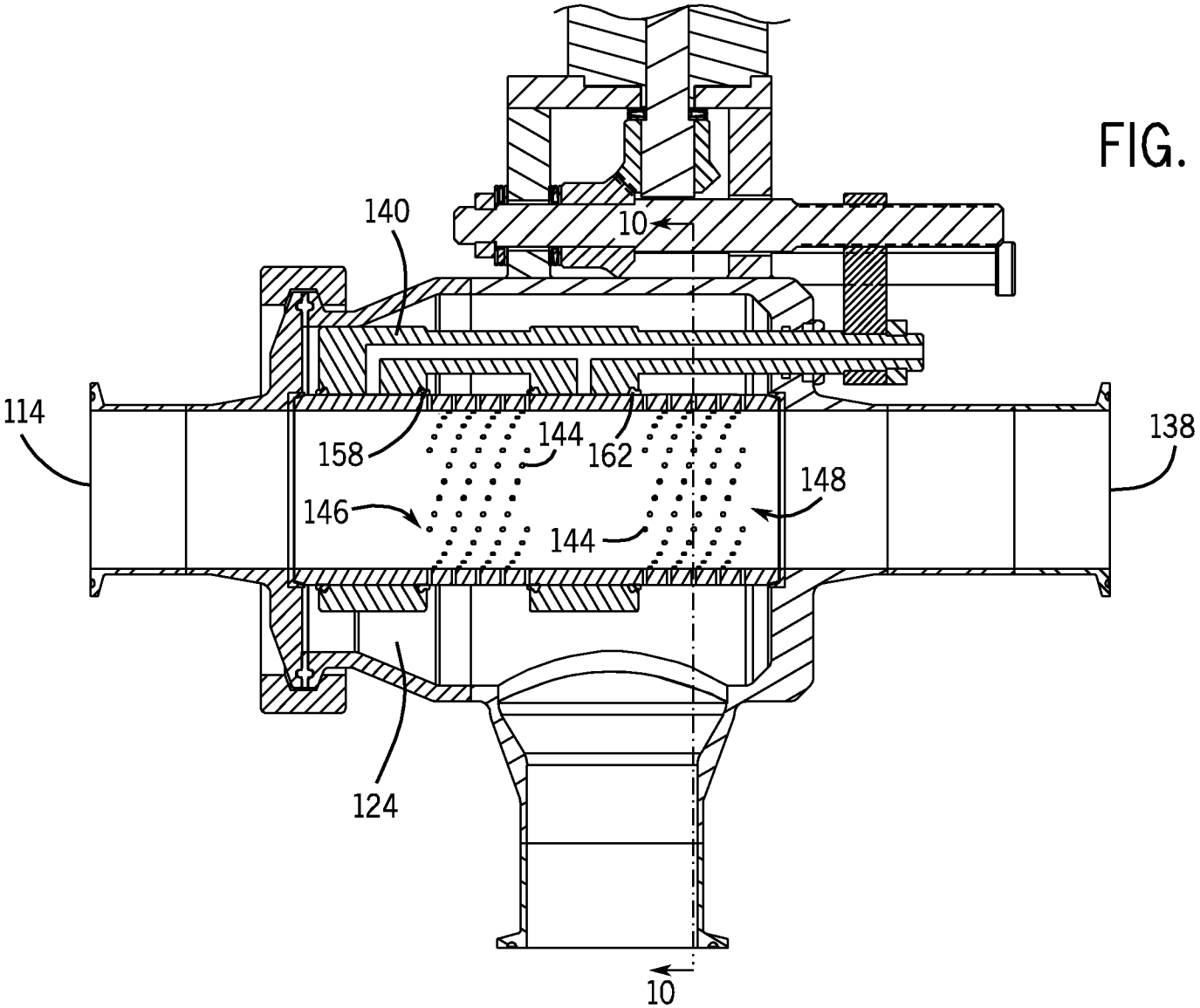
FIG. 9 is a section view similar to FIG. 8 with the adjustable regulating member in its fully open position.

FIG. 9 illustrates the regulating member 140 in its fully open, exposed position. In this position, all of the steam injection openings 144 in both the first injection zone 146 and the second injection zone 148 are exposed to steam within the steam chamber 124. In this position, a maximum amount of steam is injected into the product flow. As illustrated in FIG. 9, the regulating member 140 has moved such that the first sealing member 158 has moved past all of the steam injection openings 144. Likewise, the third sealing member 162 has moved past all of the steam injection openings 144 in the second injection zone 148.

Figure 10:
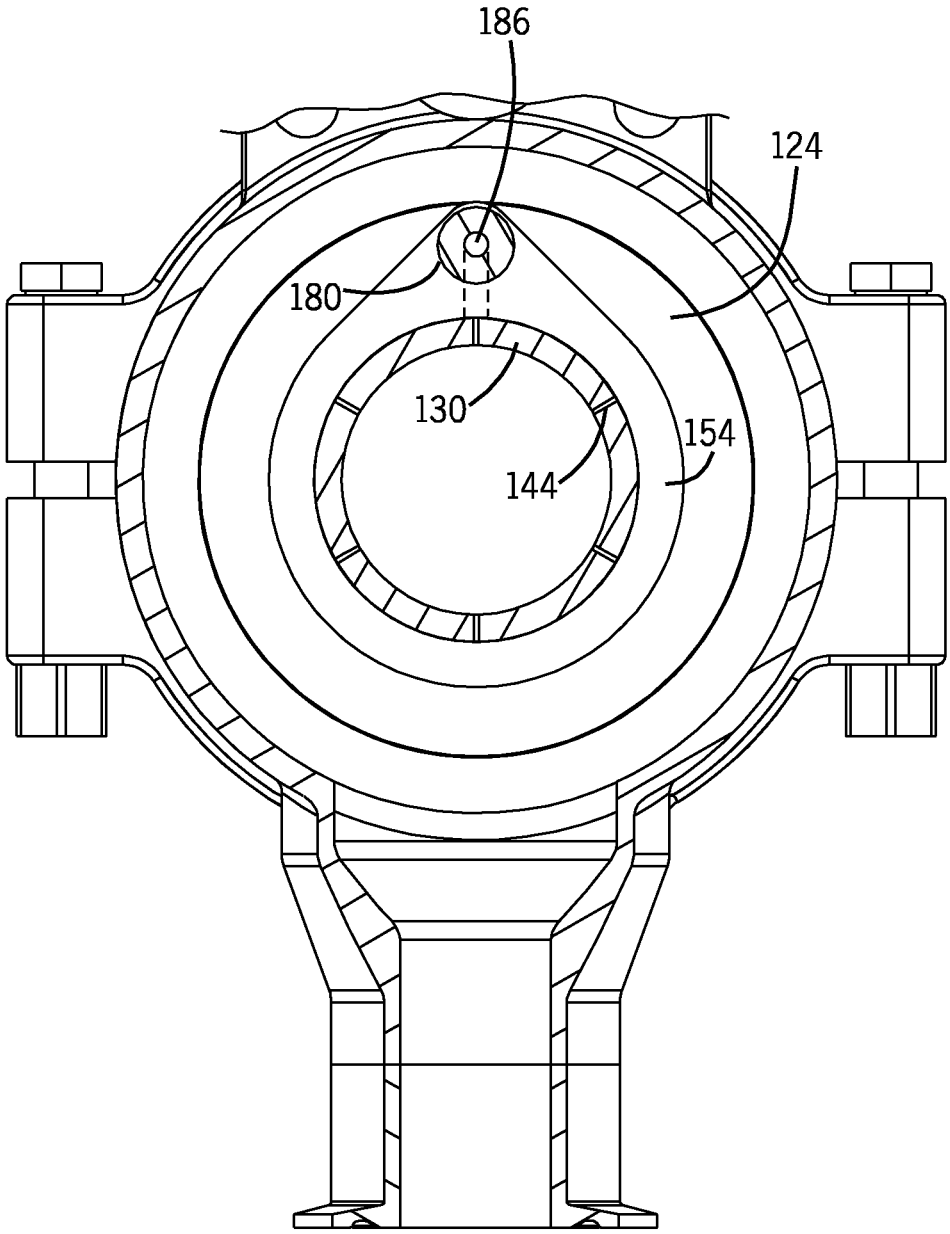
FIG. 10 is a section view taken along line 10-10 of FIG. 9.

In the embodiment shown in FIGS. 6, 8 and 10, the individual steam injection openings 144 contained in both the first injection zone 146 and the second injection zone 148 are shown distributed in a generally helical pattern. Further, the steam injection openings 144 have a generally constant spacing along the flow axis 33 shown in FIG. 6. However, it is contemplated that the distribution of the steam injection openings 144 could be varied to provide enhanced resolution at different points along the travel path of the regulating member 140 between the fully closed position shown in FIG. 6 and the fully open position in FIG. 9. As an example, the steam injection openings 144 could be more closely spaced near the downstream end of each of the injection zones 146, 148 such that as the regulating member 140 begins to expose the steam injection openings to steam within the steam chamber 124, a relatively small amount of movement of the regulating member 140 would expose a larger number of the steam injection openings. In such an embodiment, the axial spacing between the steam injection holes 144 could be greater near the upstream end of the injection zones 146, 148 to provide decreased resolution near the fully open position of the regulating member 140.

In the embodiment illustrated in FIG. 6, the entire mixing tube 130 can be removed and replaced from within the heater body 118 of the steam injection heater 110. The mixing tube 130 is removed by initially removing the clamping member 120. As illustrated in FIG. 5, the clamping member 120 can be removed by initially removing the connectors 123.

Once the clamping member 120 has been removed, the attachment fitting 112 is separated from the heater body 118 and the mixing tube 130 pulled from the heater body 118. Once the mixing tube 130 has been removed, a replacement mixing tube 130 can be inserted into the heater body. The replacement mixing tube could include a different steam injection hole pattern or simply be a replacement for a worn out mixing tube. The use of the clamping member 120 allows the attachment fitting 112 to be more easily removed from the heater body to permit replacement of the mixing tube 130 as desired.

Additionally, it is contemplated that the mixing tube 130 could be formed from various different types of materials. As an example, the mixing tube 130 could be formed from a thermoplastic material or a metal material, as desired.

Referring now to FIGS. 6 and 7, the operation of the flushing port 186 will be further described. When the regulating member 140 is in the position shown in FIG. 6, the first branch 188 of the flushing port 186 is in fluid communication with the steam injection openings 144 contained in the first injection zone 146. At the same time, the second branch 190 is in fluid communication with the steam injection openings 144 contained in the second injection zone 148. In this position, a supply of fluid or air can be connected to the flushing port 188 through the inlet opening 196 at the attachment end 192. If a supply of pressurized air is supplied to the inlet opening 196, the pressurized air will flow through both the first and second branches 188, 190 and into the flow passageway 150 of the mixing tube 130 through the series of steam inlet openings. In this manner, the pressurized air can be used to flush the steam inlet openings 144 as part of a cleaning process.

During normal operation of the steam injection heater, a supply of pressurized air can be provided within the flushing port 186 to prevent backflow of material into the flushing port 186. Additionally, the flushing port 186 could be connected to a supply of pressurized liquid such that the liquid can be injected into the product flow within the flow passageway 150 through the steam injection openings 144. As an example, if the steam injection heater 110 is used to heat a food product, a liquid additive, such as flavoring, could be supplied to the flushing port 186 for injection into the flow of material within the steam injection heater. The liquid additive would be supplied at pressure through the inlet opening 196.

In yet another alternate configuration, a negative pressure could be applied to the inlet opening 196 to draw material or liquid out of the flow passageway 150 through the steam injection openings 144. This configuration could be used for product testing or other alternate uses.

Although FIGS. 5-10 illustrate an embodiment in which steam is injected into a flow of material passing through the mixing tube 32, it is contemplated that the mixing device could be utilized to mix various different types of liquids and/or gases. As can be understood by the foregoing disclosure, the pressure of the liquid/gas within the steam chamber 124 must exceed the pressure of the liquid/gas within the open interior of the mixing tube 130 such that the liquid/gas is injected from the steam chamber 124 into the open interior of the mixing tube 130. As an illustrative example, if the steam in the steam chamber 124 were replaced with a first liquid, the pressure of the first liquid would need to exceed the pressure of the second liquid within the open interior of the mixing tube 130 for the second liquid to flow into the mixing tube 130.

Although the embodiment shown in FIG. 5 includes a automated actuator 90, the actuator 90 could be replaced by a manual system. Further, although a threaded shaft 174 is illustrated, various other types of actuator members could be utilized while operating within the scope of the present disclosure. As can be understood in FIGS. 5-10, the actuator 90 is responsible for the movement of the regulating member 140 relative to the mixing tube 130. As described, the regulating member 140 could be stationary and the mixing tube 130 move relative thereto. Any type of actuator that can effect this relative movement between the regulating member 140 and the mixing tube 130 would be acceptable.

We claim:

1. A mixing device for mixing at least a first substance and a second substance, the mixing device comprising:

a body having a first inlet in fluid communication with an open chamber such that the first substance flows through the first inlet into the open chamber;

a mixing tube extending through the open chamber, the mixing tube having a first end to receive a flow of the second substance and a second end to discharge the flow of the second substance, the mixing tube having a plurality of injection openings formed in an outer wall of the mixing tube to allow the first substance to flow into a flow passage of the mixing tube through the outer wall to mix with the second substance, wherein the plurality of injection openings are located in a plurality of distinct and separate injection zones, wherein the injection zones each include a subset of the plurality of the injection openings and the injection zones are separated from each other by a portion of the mixing tube devoid of openings; and a regulating member surrounding at least a portion of the mixing tube, wherein the regulating member includes a plurality of regulating sections each movable along one of the plurality of injection zones, wherein the regulating member and the mixing tube are movable relative to each other such that each of the plurality of regulating sections move along one of the plurality of injection zones to simultaneously expose a varying number of the injection openings in each of the plurality of injection zones to the open chamber.

2. The mixing device of claim 1 wherein the second substance flows through the mixing tube along a flow axis and the first substance is injected into the mixing tube through the injection openings that each extend radially relative to the flow axis.

3. The mixing device of claim 1 wherein the injection openings in the mixing tube are located in the plurality of injection zones of the mixing tube having a generally constant inner diameter.

4. The mixing device of claim 1 wherein the mixing tube is stationary and the regulating member is movable relative to the mixing tube.

5. A steam injection heater for heating a product flow comprising:

a heater body having a steam inlet in communication with a steam chamber to receive steam passing through the steam inlet;

a mixing tube extending through the steam chamber, the mixing tube having a first end to receive the flow of product and a second end to discharge the flow of product after heating, the mixing tube having a plurality of injection openings formed in an outer wall of the mixing tube to allow steam to flow into a flow passage of the mixing tube through the outer wall, wherein the plurality of steam injection openings are located in at least a first injection zone and a second injection zone separated from the first injection zone by a portion of the mixing tube devoid of openings; and a regulating member positioned to surround at least a portion of the mixing tube, wherein the regulating member includes a first regulating section movable along the first injection zone and a second regulating section movable along the second injection zone to selectively expose the plurality of steam injection openings in the first and second injection zones, the regulating member further including an access area formed between the first regulating section and the second regulating section.

6. The steam injection heater of claim 5 wherein the product flow travels along a flow axis and the steam enters into the mixing tube through the steam injection openings that each extend radially relative to the flow axis.

7. The steam injection heater of claim 5 further comprising an actuator operable to create the relative movement between the mixing tube and the regulating member.

8. The steam injection heater of claim 7 wherein the mixing tube is stationary and the regulating member is movable relative to the mixing tube.

9. The steam injection heater of claim 7 wherein the actuator is operable to move the regulating member and the mixing tube relative to each other to selectively expose or cover the steam injection openings to control the inward flow of steam into the product flow contained within the open passage of the mixing tube.

10. The steam injection heater of claim 5 wherein the mixing tube is removable from the heater body.

11. A steam injection heater for heating a product flow comprising:

a heater body having a steam inlet in communication with a steam chamber to receive steam passing through the steam inlet;

a mixing tube extending through the steam chamber, the mixing tube having a first end to receive the flow of product and a second end to discharge the flow of product after heating, the mixing tube having a plurality of injection openings formed in an outer wall of the mixing tube to allow steam to flow into a flow passage of the mixing tube through the outer wall; and a regulating member positioned to surround at least a portion of the mixing tube, wherein the regulating member and the mixing tube are selectively movable relative to each other to selectively expose the plurality of steam injection openings to the steam chamber, wherein the regulating member includes a flushing port in fluid communication with the plurality of injection openings formed in the outer wall of the mixing tube.

12. The steam injection heater of claim 5 wherein the regulating member includes a flushing port in fluid communication with the plurality of injection openings formed in the outer wall of the mixing tube.

13. The steam injection heater of claim 5 wherein the regulating member includes a first flushing port formed in the first regulating section and a second flushing port formed in the second regulating section.

* * * * *